US005906553A

United States Patent [19]

Carroccio

[11] Patent Number: 5,906,553

[45] Date of Patent: May 25, 1999

[54] OUTDOOR PRACTICE FACILITY

[76] Inventor: Tony Carroccio, 3650 Page St., Chicago, Ill. 60634

[21] Appl. No.: 08/906,796

[22] Filed: Aug. 5, 1997

[51] Int. Cl.[6] ..... A63B 69/40

[52] U.S. Cl. ..... 473/421

[58] Field of Search ..... 473/421, 420, 473/490, 439, 459, 417; 472/94

[56] References Cited

U.S. PATENT DOCUMENTS

| | | | |
|---|---|---|---|
| 1,591,753 | 7/1926 | Flaugh | 473/421 |
| 1,931,387 | 10/1933 | Kelliher . | |
| 2,292,109 | 8/1942 | Engel | 473/421 |
| 3,024,024 | 3/1962 | Chalcroft . | |
| 3,858,880 | 1/1975 | Graves | 473/459 |
| 3,948,512 | 4/1976 | Worthington | 473/459 |
| 3,980,304 | 9/1976 | O'Neill | 473/421 |
| 4,037,837 | 7/1977 | Bauer . | |
| 4,227,691 | 10/1980 | Lefebver | 473/417 |
| 5,106,085 | 4/1992 | Lewy | 473/417 |
| 5,417,438 | 5/1995 | Poff | 473/421 |
| 5,639,084 | 6/1997 | Kawasaki | 473/421 |

*Primary Examiner*—Theatrice Brown
*Attorney, Agent, or Firm*—John W. Harbst

[57] ABSTRACT

An outdoor baseball practice facility including a playing surface with a plurality of adjacent stations arranged thereon. Each station of the present invention includes a homeplate with angularly diverging baselines extending away therefrom to define a playing field therebetween. The baselines of any one station overlap the baselines of one or more adjacent stations. The baselines of each station have a distinguishable appearance from the baselines of other adjacent stations to allow a batter to better appreciate whether a struck ball remains within a specified playing field. Each station of the present invention furthermore includes an apparatus for presenting balls at an elevated distance above the homeplate of each station. A homerun area on the playing surface is disposed a predetermined distance away from the homeplate of each station.

17 Claims, 5 Drawing Sheets

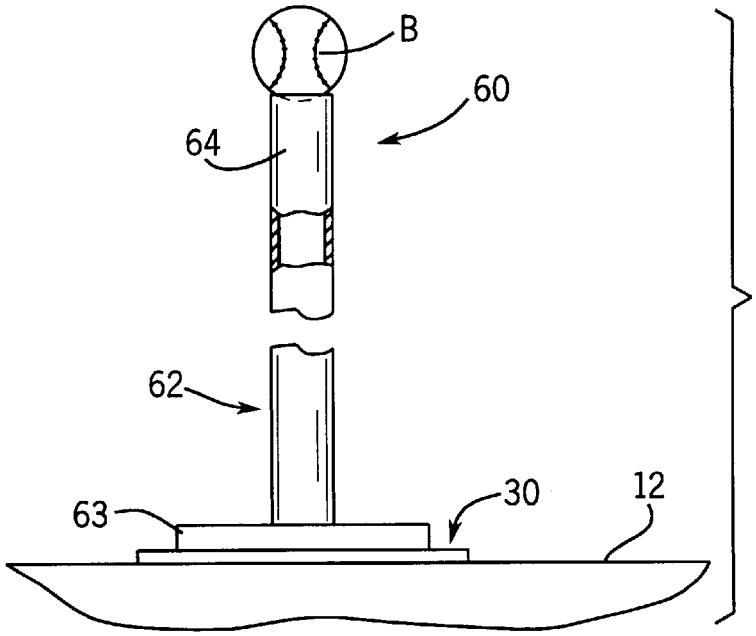
FIG. 5
FIG. 6
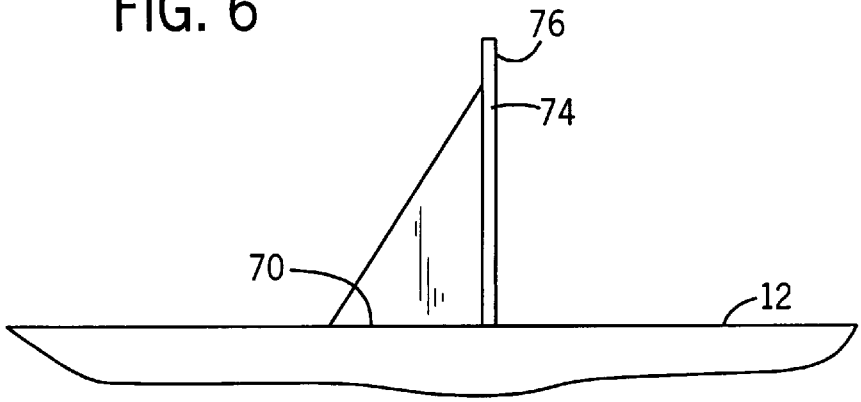

OUTDOOR PRACTICE FACILITY

FIELD OF THE INVENTION

The present invention relates to sports facilities and, more specifically, to an outdoor facility for practicing hitting of baseballs and the like.

BACKGROUND OF THE INVENTION

Baseball has been America's favorite pastime for many years and has vast appeal. That is, baseball appeals to the young and the old, boys as well as girls, and to women and men. At some point in many peoples lives, we have imagined what it would be like to stand in a batters box and hit a ball in an actual baseball field. Unfortunately, because of the upkeep, insurance and a myriad of additional reasons, few people outside of baseball players get to experience the joy and delight associated with hitting a baseball in actual field conditions. Few people outside of baseball get to experience the joy of what it would be like to hit a baseball a distance resembling a homerun in the major baseball leagues.

Baseball batting cages are known in the art. Such batting cages typically are confined spaces wherein a ball is mechanically thrown toward a batter. In these arrangements, however, the ball hit by the batter cannot pass beyond the confines of the cage wherein the batter is disposed. Accordingly, and because the batter is confined within relatively tight space constraints, there is no adequate manner by which the batter can judge how well the ball is hit. Moreover, there is no comparison of a small batting cage with an open field. Thus, the thrill obtainable on a field when the ball is well hit is not equaled in a batting cage.

Thus, there continues to be a need and a desire for an outdoor baseball practice facility wherein a player can practice hitting a baseball in conditions which more accurately depict playing fields of major league parks.

SUMMARY OF THE INVENTION

In view of the above, and in accordance with the present invention, there is provided a baseball practice facility which more equally compares with the playing field of major league parks. The baseball practice facility of the present invention includes an open playing surface preferably having a generally flat contour. A plurality of stations are disposed on the playing surface to allow one or several people to practice their baseball hitting skills simultaneously. Each station on the field includes a home plate from which a ball is hit radially outward into,an open field. A salient feature of the present invention relates to the provision of foul lines associated with each station of the facility and extending in divergent directions from each other and away from the home plate.

To economize on space, at least one foul line of one station extends in overlying relation to a foul line of at least one adjacent station. The foul lines associated with each station are visually identifiable or distinguishable from the foul lines of another station to provide a visual indication whether a ball hit from home plate remains within a playing field defined by the foul lines of that particular station.

As will be appreciated by those who have played ball, it is relatively common to hit a baseball in a foul direction when practicing a swing. In this regard, another feature of the present invention relates to the provision of a protective structure arranged in surrounding relation relative to each station. The protective structure is disposed to inhibit foul balls from an adjacent playing station from striking a person in another playing station.

To enhance a players or batters pleasure during practice, the playing surface of the baseball practice facility of the present invention is entirely open. The playing field, defined between the foul lines of each station, generally corresponds in size to the playing fields of professional baseball. Thus, a person standing at a station of the practice facility can better appreciate whether the ball she/he hits stays within the normal boundaries of a professional playing field.

As will be appreciated, one of the more exciting moments during a baseball game is when a player hits a homerun. In this regard, the playing surface of the baseball practice facility of the present invention is preferably marked with an area a predetermined distance from the home plate of every station for indicating when a homerun is hit. The predetermined distance marked on the field ranges between about 325 feet to about 400 feet from the home plate of every station. Moreover, various markers can be arranged about the playing surface to also indicate how far a particular ball was hit.

In a preferred form of the invention, the baseball practice facility further includes an apparatus for presenting baseballs to the various stations at an elevated distance above the home plate of each station. In one form, such apparatus includes a free standing support extending substantially normal to the playing surface for supporting a baseball at a free end thereof. Alternatively, a baseball throwing machine, capable of throwing real baseballs at various speeds, can be arranged in combination with one or a plurality of stations for throwing a ball to the station. Moreover, suitable markings are preferably provided about the home plate of each station representative of a batters box.

To promote the length of time the present invention can be used, suitable lighting is provided for illuminating the playing surface and each station. Suitable signage can also be provided in and about the playing field for posting the regulations of the game.

With the present invention, the fun of practicing on a field similar to that of major league ball players can be captured for other J)layers. Because the foul lines of adjacent fields overlap, a plurality of players can partake of practice/fun simultaneously. Moreover, with the present invention, it is possible for the hitter to see where and how far the ball being hit travels and how that performance compares with others. The addition of a homerun area adds still further enjoyment to the game.

These and other objects, aims and advantages of the present invention will be appreciated from the following detailed description of the drawings, the description of the invention, and the appended claims.

DETAILED DESCRIPTION OF THE DRAWINGS

FIG. 5 is a side elevational view, partially in section, of a support apparatus for presenting a baseball at an elevated distance above a home plate of a station forming part of the present invention;

FIG. 6 is an elevational view schematically illustrating a playing field separated from a homerun area;

DESCRIPTION OF THE PRESENT INVENTION

Figure 1:
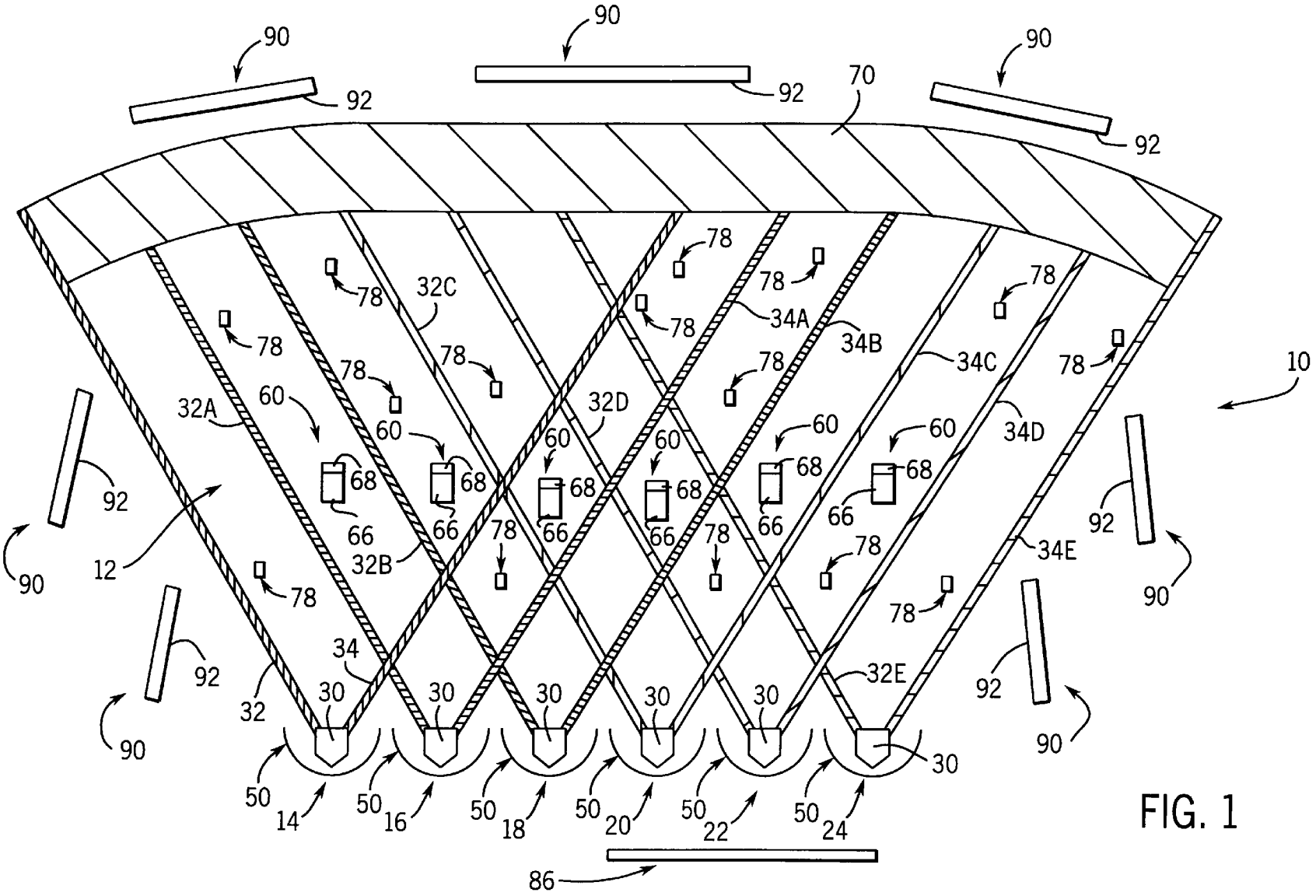
FIG. 1 is a top plan view schematically illustrating the present invention.

While the present invention is susceptible of embodiment in various forms, there is shown in the drawings and will hereinafter be described in detail, a specific embodiment with the understanding that the present invention is to be considered as setting forth an exemplification of the principles of the invention and is not intended to limit the invention to the specific embodiment illustrated.

Referring now to the drawings, wherein like reference numerals indicate like parts throughout the several views, FIG. 1 illustrates an outdoor baseball practice facility according to the present invention and generally indicated by reference numeral 10. The practice facility 10 includes a playing surface 12 with a plurality of stations 14, 16, 18, 20, 22 and 24 on the playing surface 12. As will be appreciated, more or less playing stations from that shown could be provided without detracting or departing from the spirit and scope of the present invention. Preferably, playing surface 12 is configured as a generally flat surface with grass or the like covering the vast majority thereof.

Stations 14 through 24 are substantially identical to each other. Accordingly, only station 14 will be described in detail with the understanding that the remaining stations are substantially similar in structure.

Figure 2:
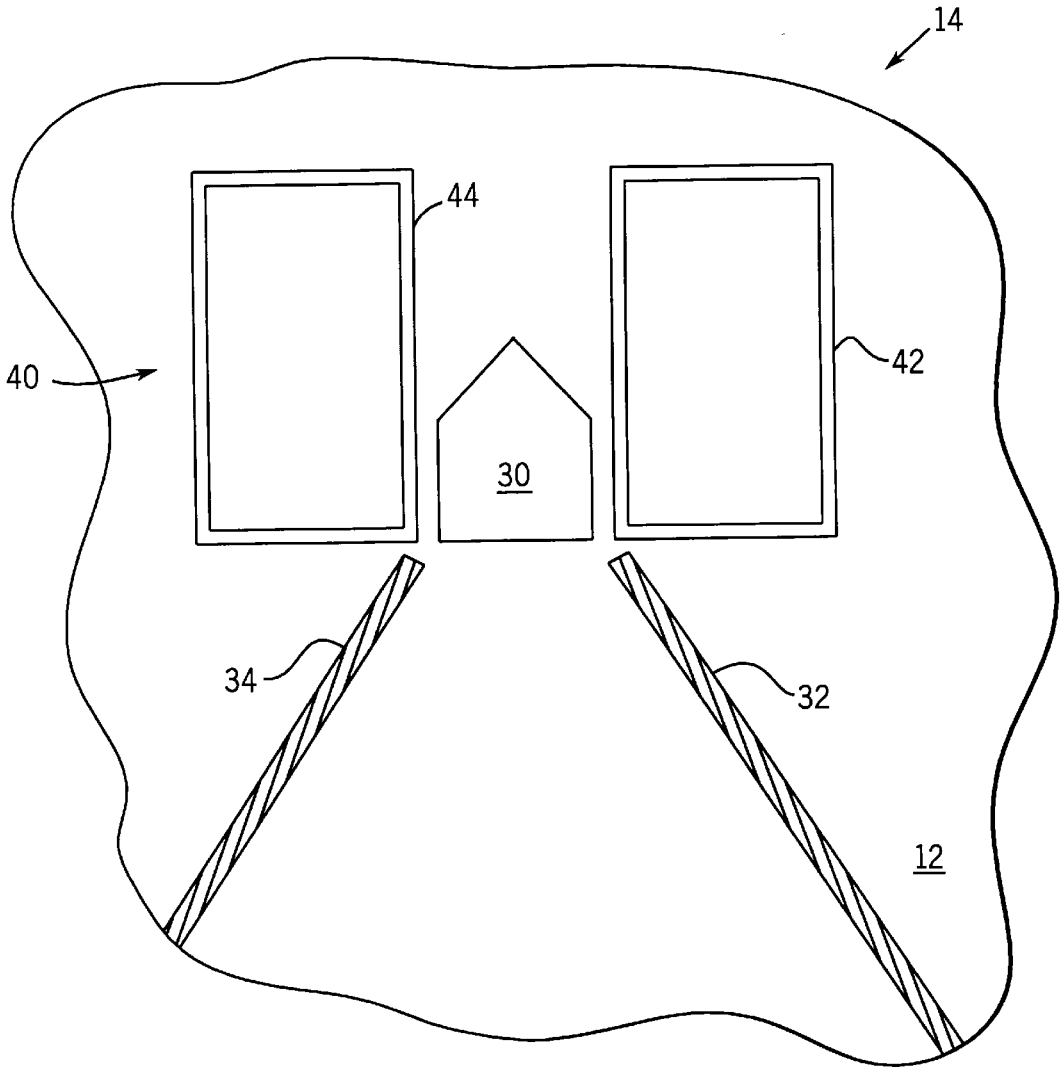
FIG. 2 is an enlarged fragmentary top plan view of a home plate with a batters box arranged in association therewith.

As shown in FIG. 2, each station on the playing surface 12 includes a generally planar home plate 30 of any suitable material and having a conventional and well-known configuration. As shown, a pair of baselines or foullines 32 and 34 extend radially away from the home plate 30. Notably, the foullines 32, 34 extend in angularly divergent directions from each other and away from the home plate 30 to define a playing field therebetween.

To economize on space, at least one baseline or foulline of one station of the facility 10 extends in overlying relation to a baseline or a foulline of at least one adjacent station. As shown in FIG. 1, the baseline or foulline 34 of station 14 crosses over a lengthwise portion of baselines or foullines 32A, 32B, 32C, 32D and 32E of stations 16, 18, 20, 22 and 24, respectively. Similarly, baseline or foulline 34A of station 16 crosses over a lengthwise portion of baselines or foullines 32B, 32C, 32D and 32E. Moreover, and because of the adjacent relationship of stations 16 and 18, baseline or foulline 34B crosses over a lengthwise portion of baselines or foul lines 32C, 32D, and 32E. As will be appreciated, the baselines 32, 34 of the remaining stations 20, 22 and 24 likewise crossover baselines of their adjacent stations. Ultimately, the playing field defined between any two baselines or foullines of a playing station has a size generally corresponding to that of a major league ballpark.

The baselines or foul lines of each station 14 through 24 of the facility 10 are visually distinguishable from each other to permit a batter to appreciate whether a ball hit from a particular station remains within the playing field defined by that station. The visual distinctiveness of the foul lines 32, 34 of any particular station can be effectively accomplished in any of a plurality of ways. For example, the foul lines 32, 34 associated with various stations can be of a different color from each other. Alternatively, the foullines or baselines 32, 34 of the various stations 14 through 24 can have different signatures. That is, the baselines or foullines of station 14 can have a signature including a series of dashed lines while the foullines or baselines associated with station 16 may have a solid-like configuration or other suitable configuration such that the two lines are readily distinguishable from each other. Moreover, the foullines or baselines 32, 34 of each station can be painted, marked as with chalk or the like, different color tapes, or other suitable markings sufficient to withstand an outdoor environment. Alternatively, each baseline 32, 34 of each station can be configured as a upstruck relatively short vertical wall to enhance the ability to track a struck ball as it travels over the playing field from the home plate 30 of a respective station.

Moreover, and as shown in FIG. 2, each station on the playing surface 12 includes a batters box 40. More specifically, the batters box 40 includes two rectangularly shaped outlines 42 and 44 disposed to opposite sides of the home plate 30. As with the baselines 32, 34 of each station, the outlines 42, 44 of the batters box 40 can be formed from tape, chalk or any other suitable marking capable of withstanding an outdoor environment. Moreover, the outlines 42, 44 of batters box 40 have substantial configurations and are disposed relative to the home plate 30 as those associated with major league ballparks. Suffice it to say, the outlines 42, 44 of batters box 40 are approximately 7 to 8 feet in length and about 2 feet to 2 feet 6 inches in width.

Figure 3:
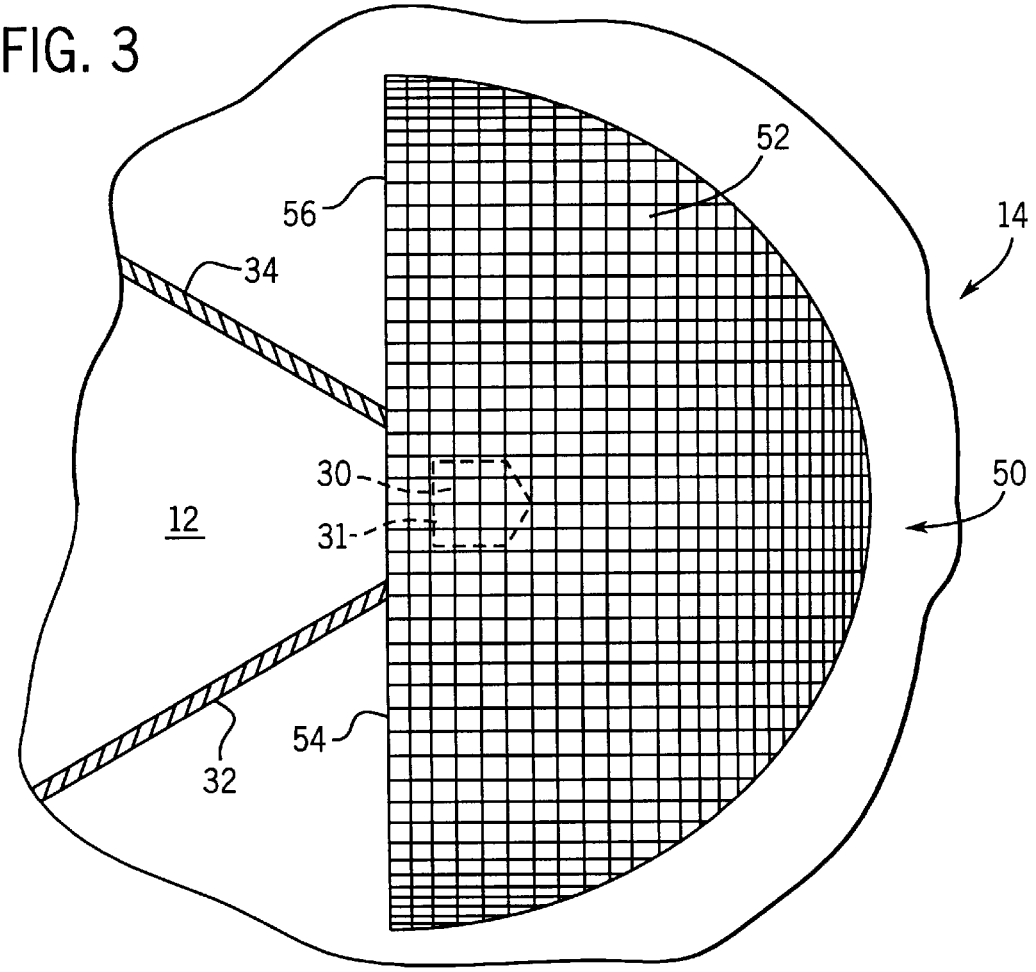
FIG. 3 is a top plan view of a station forming part of the present invention, with foul lines extending outwardly therefrom.
Figure 4:
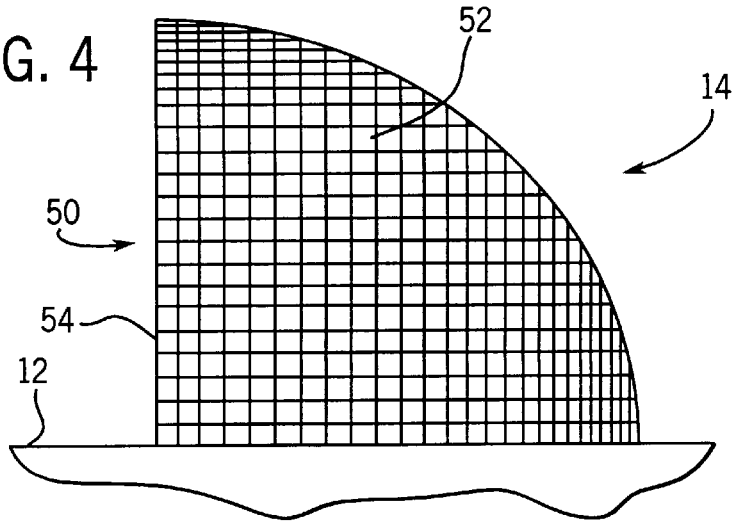
FIG. 4 is a side elevational view of the station illustrated in FIG. 3.

Because of their relatively close or adjacent proximity to each other, and as schematically illustrated in FIG. 1, each station on the playing surface further includes a protective structure 50 to inhibit baseballs from an adjacent station interfering with the player at an adjacent station. As shown in FIGS. 3 and 4, the protective structure 50 preferably includes a form of batting cage 52 arranged in surrounding relationship relative to the home plate 30 of a respective station. In the illustrated form of the invention, batting cage 52 includes a generally semi-spherical configuration having a front side 54 opening to the playing field of a respective station. As shown in FIG. 3, a front edge 56 of the batting cage 52 is disposed slightly forward of the front edge 31 of home plate 30 to limit sideways travel of struck balls from the station. As further illustrated in FIGS. 3 and 4, a portion of each cage 52 extends vertically over the home plate 30 of each respective station.

Preferably, each batting cage 52 is formed from a net-like material extending over a rigid understructure. In a most preferred form of the invention wire screening is used to protect the player at a particular station from inadvertently directed balls from an adjacent station or elsewhere.

The facility 10 of the present invention further includes an apparatus 60 for presenting baseballs to the various stations at an elevated distance above the homeplate 30 of each station. In one form of the invention, and as shown in FIG. 5, apparatus 60 includes a freestanding support 62 for positioning or presenting a baseball at an elevated distance above the homeplate 30 of each station. As shown, support 62 includes a base 63 and an upstanding preferably cylindrical tube 64 extending generally normal or perpendicular to the playing surface 12. At least the upper free end of the cylindrical tube 64 is preferably hollow to accommodate a baseball B at a predetermined distance above the playing surface 12. Of course, supports 62 having different lengths of tubes 64 can be used to accommodate players of different sizes.

Alternatively, and as shown in FIG. 1, apparatus 60 includes one or more pitching machines 66 for pitching or throwing real baseballs toward and at elevated distances above the homeplate 30 of each station. In the illustrated form of the invention, one pitching machine 66 is provided for each station 14 through 22. It is within the spirit and scope of the present invention, however, for one pitching machine 66 to pitch or throw real baseballs at more than one station. Moreover, each machine 66 is manually adjustable as through a conventional adjusting device 68 to adjust the speed with which the ball is propelled toward the homeplate 30 of each station.

As schematically illustrated in FIG. 1, and to add a degree of excitement to the facility 10, the playing surface 12 is marked or otherwise indicated with an area 70 a predetermined distance from the homeplate 30 of each station for indicating when a homerun has been hit. The homerun area 70 can be marked in any suitable manner. That is, the playing surface 12 can be colored a different color from the remaining portion of the playing field in the homerun area 70. Alternatively, and as shown in FIG. 6, a relatively short vertical wall 74 separates the homerun area 70 from the remainder of the playing field on the playing surface 12. Wall 74 furthermore provides a relatively large surface 76 for advertisements and the like.

The homerun area 70 on the playing surface 12 is disposed between about 325 feet to about 400 feet from the home plate 30 of each playing station. Preferably, and as shown in FIG. 1, the homerun area 70 has an arcuate configuration. As such, and as measured along each foul line or baseline 32, 34 of each station, the homerun area begins at about 325 feet. In contrast, the homerun area 70 disposed between the foul lines or baselines 32, 34 of any station measures approximately 400 feet from the homeplate 30 of a respective station.

To facilitate a player better appreciating their performance, and as shown in FIG. 1, the playing field for each station of the present invention is provided with markers 78. The markers 78 are disposed at different places in the playing field of each station and at various distances from the home plate 30 of that station.

Figure 7:
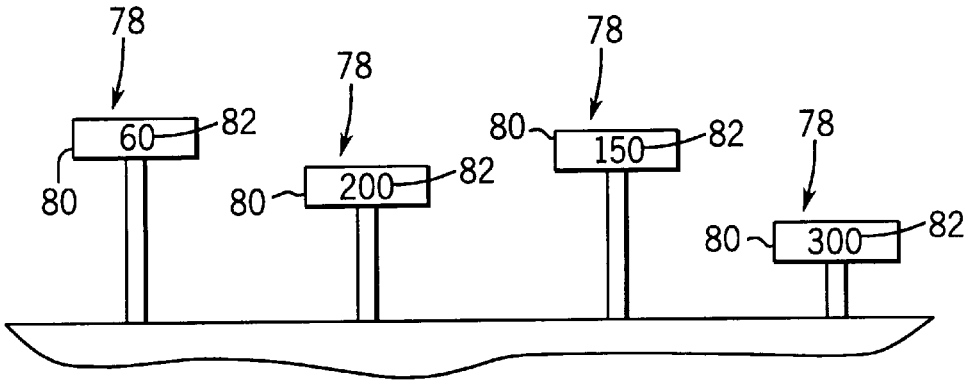
FIG. 7 is an elevational view of various markers arranged in combination with the present invention.

As shown in FIG. 7, each marker 78 has a relatively broad surface 80 disposed above the playing surface 12 and on which is marked a number 82 indicative of how far, in feet, the marker 78 is disposed from the homeplate 30 of a respective station. As will be appreciated, each marker 78 can take a myriad of different shapes and forms. Suffice it to say, the purpose of each marker 78 is to provide a readily visible image to a person standing at homeplate 30 of a particular station how far a ball has been hit. Any suitable structure for accomplishing that purpose will suffice and is intended to fall within the spirit and scope of the present invention.

Figure 8:
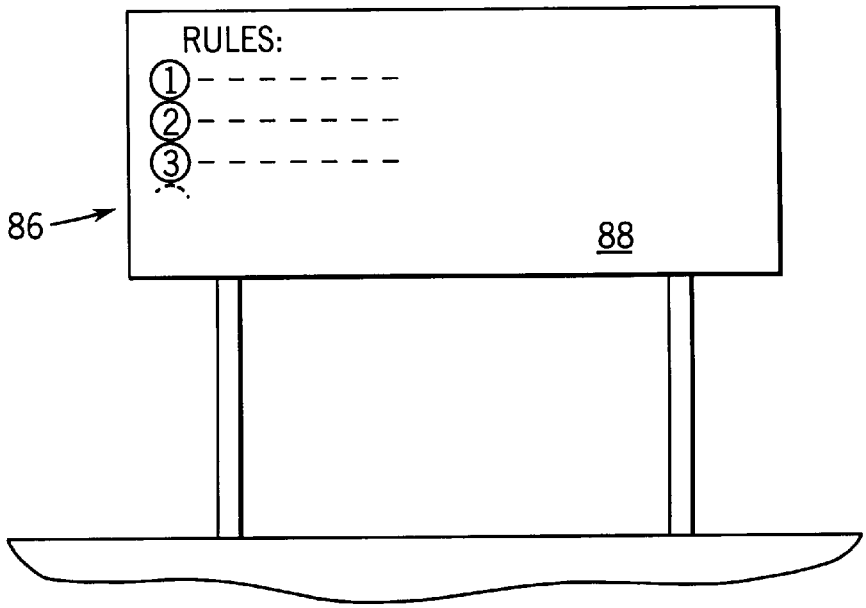
FIG. 8 is an elevational view of signage associated with the present invention.

As further shown in FIG. 1, a vertical wall or other suitable surface 86 is provided adjacent to stations 14 through 24. As shown in FIG. 8, the wall 86 defines a relatively large flat surface 88 on which rules and regulations for using facility 10 are provided. Depending upon the surface area thereof, the wall 86 could likewise provide for advertisements for other products or services.

Returning to FIG. 1, facility 10 can further include suitable lighting 90. Lighting 90 is intended to illuminate both the playing surface 12 as well as each of the stations 14 through 22 to prolong the usefulness of the facility 10 into the evening hours. Lighting 90 preferably includes high output lights 92 elevated from and directed toward the playing surface 12 and stations 14 through 22 for providing suitable illumination thereof.

The facility 10 of the present invention provides an outdoor baseball practice range. Each station 14 through 22 of the facility 10 defines a playing field between the respective foullines or baselines 32, 34 thereof. The playing field defined between the foullines or baselines 32, 34 of any particular station generally corresponds in size to that of any major league ballpark. The visual differences between the foullines or baselines 32, 34 of adjacent stations advantageously allows a substantially reduced playing surface to accommodate a plurality of various stations.

As mentioned above, in a preferred form of the invention, the foullines 32, 34 of the various stations are distinguishable from each other thereby allowing a player to readily appreciate whether a ball that has been hit remains within the playing field. It is also within the spirit and scope of the present invention, however, that the playing field defined between the foullines or baselines of one station is distinguishable from the playing field of an adjacent station as by coloring or otherwise highlighting the entire field in a manner distinguishing the two fields from each other. A salient feature of the present invention being the overlying relationship between the two fields so as to economize on space requirements.

The protective structure 50 arranged over and about the homeplate of any particular stations protects the player in that station from foul balls or otherwise misdirected balls from other stations. In this regard, the front edge 56 of each protective structure 50 extends slightly forward of the homeplate 30 of that station to inhibit balls from inadvertently travelling in directions adverse to players at other stations.

The provision of the homerun area 70 on the playing surface 12 of the facility furthermore enhances the present invention. The homerun area 70 is clearly separated from the remainder of the playing surface 12 to readily allow the batter to appreciate when the ball is hit that far. The separation of the homerun area 70 from the remainder of the playing surface 12 can be accomplished either by suitable markings in the homerun area 70 or the vertical wall 74 for separating the homerun area 70 from the remainder of the playing surface. As will be appreciated, the wall 74 would likewise provide a suitable surface for adding advertisements thereto, thus, further lending the facility 10 of the present invention to a professional baseball environment.

As mentioned above, the ability to present baseballs to each station at an elevated distance above the homeplate can be accomplished in a number of ways. First, and especially for younger players, a support 62 can be provided to position a baseball at an elevated distance above the homeplate to allow the ball to be hit into the playing field. Alternatively, the pitching machine 66 can be used to throw balls toward the homeplate 30 of a particular practice station. If so desired, the pitching machine 66 can also be modified to pitch a "softball" toward the homeplate 30 along an arcuate path such that the balls can be provided at random speed toward the homeplate.

To promote the length of time the present invention can be used, the lighting 90 is provided for illuminating the playing surface 12 and each practice station 14 through 22. Moreover, suitable signage 96 can be also provided for posting the regulations of the game.

From the foregoing, it will be observed and numerous modifications and variations can be affected without departing from the true spirit and scope of the novel concept of the present invention. It will be appreciated if the present disclosure is intended as an exemplification of the invention and is not intended to limit the invention to the specific embodiment illustrated. The disclosure is intended to cover by the appended claims. All such modifications must fall within the scope of the claims which is then followed by the claims.

What is claimed is:

1. An outdoor baseball practice facility, comprising:

a playing surface defining an unobstructed playing area having a generally flat contour between opposed ends thereof, and wherein said playing area ranges about 325 feet and about 400 feet between said opposed ends;

a plurality of stations disposed on and arranged toward one end of the playing area, each station including a home plate from which a ball is hit radially outwardly therefrom, and foul lines extending in divergent directions from each other and away from the home plate, with at least one foul line of one station extending in overlapping relation to a foul line of at least one adjacent station, and wherein the foul lines associated with each station are visually identifiable from the foul lines of another station to provide a visual indication whether a ball hit from home plate remains within a range defined by the foul lines of that particular station, and with the flat contour of the playing surface yielding visual access to how far from home plate and where on the playing surface a ball hit from home plate will actually fall.

2. The baseball practice facility according to claim 1 wherein each station is surrounded by a protective structure a portion of which extends over a respective playing station to inhibit balls from an adjacent station from interfering with a person at an adjacent station.

3. The baseball practice facility according to claim 1 wherein the playing area of the playing surface is marked with a zone a predetermined distance from the home plate of each station for visually indicating when a home run is hit.

4. The baseball practice facility according to claim 3 wherein said predetermined distance measures approximately 325 feet from the home plates of the stations as measured along each foul line of the stations.

5. The baseball practice facility according to claim 1 further including adequate lighting to illuminate the playing surface and each station to prolong the usefulness of the facility into the evening hours of any day.

6. The baseball practice facility according to claim 1 wherein a batters box is marked on said playing surface in association with the home plate of each station.

7. An outdoor baseball practice facility, comprising:

a generally flat playing surface measuring approximately 325 feet and about 400 feet between opposed ends thereof, and wherein said playing surface is unobstructed between said opposed ends thereof;

a plurality of stations on the playing surface, each station including a home plate from which a ball is hit radially outward therefrom, and foul lines extending in divergent directions from each other and away from the home plate to define a baseball playing field therebetween for each station, with at least one foul line of one station extending in overlying relation to a foul line of at least one adjacent station, and wherein the foul lines associated with each station are distinguishable from the foul lines of another station, and with the flat playing surface yielding visual access to how far from home plate and where on the baseball playing field a ball hit from home plate will actually fall; and an apparatus for presenting baseballs to the various stations at an elevated distance above the home plate of each station.

8. The baseball practice facility according to claim 7 wherein each station is surrounded by a protective structure, and wherein a portion of the protective structure extends vertically over the home plate of a respective station to inhibit balls from adjacent stations from interfering with play.

9. The baseball practice facility according to claim 7 wherein the baseball playing field of each station is marked with an area a predetermined distance from the home plate of each station for visually indicating when a home run is hit.

10. The baseball practice facility according to claim 9 wherein said predetermined distance ranging between about 325 feet and about 400 feet from the home plate of each station.

11. The baseball practice facility according to claim 7 further including markers disposed randomly in and extending vertically upward from the unobstructed flat contour of each baseball playing field to enhance visual access of how far from home plate a ball is hit.

12. The baseball practice facility according to claim 7 wherein a batters box is marked on the playing surface in association with the home plate of each station.

13. The baseball practice facility according to claim 7 wherein said apparatus for presenting balls to the station includes a free standing support disposed adjacent to a home plate of a respective station, with said support extending substantially normal to the baseball playing field for supporting a baseball at a free end thereof.

14. The baseball practice facility according to claim 7 wherein said apparatus for presenting baseballs to the stations includes a baseball throwing machine.

15. The baseball practice facility according to claim 14 wherein said baseball throwing machine is capable of throwing baseballs at adjusted speeds toward the home plate of a station.

16. The baseball practice facility according to claim 7 wherein said apparatus for presenting baseballs to the stations includes one baseball throwing machine for each station.

17. The baseball practice facility according to claim 7 wherein said stations are arranged on said playing surface in adjacent relationship relative to each other.

* * * * *